US006530800B2

(12) United States Patent
Nakamura

(10) Patent No.: US 6,530,800 B2
(45) Date of Patent: Mar. 11, 2003

(54) CONNECTOR AND METHOD FOR ASSEMBLING A CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/074,485

(22) Filed: Feb. 12, 2002

(65) Prior Publication Data

US 2002/0160644 A1 Oct. 31, 2002

(30) Foreign Application Priority Data

Apr. 26, 2001 (JP) ..... 2001-130258

(51) Int. Cl.[7] ..... H01R 13/627
(52) U.S. Cl. ..... 439/352; 439/489
(58) Field of Search ..... 439/352, 489, 439/350, 351, 353, 354, 355, 357, 358, 188, 137, 139, 140, 141, 488

(56) References Cited

U.S. PATENT DOCUMENTS

| | | | | |
|---|---|---|---|---|
| 5,370,543 A | | 12/1994 | Hamada et al. | 439/188 |
| 5,785,546 A | * | 7/1998 | Hamai et al. | 439/354 |
| 6,135,802 A | | 10/2000 | Nakamura | 439/352 |
| 6,241,547 B1 | | 6/2001 | Fukuda | 439/352 |
| 6,341,974 B1 | | 1/2002 | Konoya | 439/352 |

FOREIGN PATENT DOCUMENTS

| | | |
|---|---|---|
| DE | 197 14 459 | 10/1998 |
| EP | 0 554 827 | 8/1993 |
| EP | 0 583 056 | 2/1994 |
| EP | 0 841 724 | 5/1998 |
| EP | 0 867 976 | 9/1998 |
| EP | 0 994 532 | 4/2000 |
| JP | 8-50949 | 2/1996 |

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A connector includes male and female housings (10, 30). The male housing (10) has a receptacle (11) and lock arm (18) projects into the receptacle (11) for locking the female housing (30). A slider (60) is assembled in the female housing (30) and is biased forwardly by springs (61). The lock arm (18) is resiliently deformable between an engaging position where the lock arm (18) is engageable with the slider (60) and a disengaging position where the lock arm (18) is disengaged from the slider (60). If a connecting or separating operation is interrupted halfway, spring forces accumulated in the springs (61) are released and push the slider (60) against the lock arm (18) to forcibly separate the housings (10, 30).

13 Claims, 13 Drawing Sheets

CONNECTOR AND METHOD FOR ASSEMBLING A CONNECTOR

BACKGROUND OF THE INVENTION

1. Field of the Invention

The invention relates to a connector and a method for assembling a connector to allow for a connection detecting function.

2. Description of the Related Art

A connector with a connection detection capability is disclosed in U.S. Pat. No. 6,135,802 and also is shown in FIG. 16 herein. The connector includes a female housing 1 and a male housing 2 that can be connected with one another. The female housing 1 is formed with a lock arm 3 for locking the housings 1, 2 in a connected condition. A slider 4 is mounted in the male housing 2 and a coil spring 5 is provided at the rear wall of the male housing 2 for biasing the slider 4 forwardly. The lock arm 3 deforms resiliently while the housings 1, 2 are being connected and pushes the slider 4 against the biasing force of the coil spring 5. The lock arm 3 is restored resiliently to its original shape when the housings 1, 2 are connected properly to lock the housings 1, 2 together. The slider 4 then disengages from the lock arm 3 and is returned to its initial position by the biasing force of the coil spring 5.

The connection could be interrupted with the housings 1, 2 only partly connected. In this situation, the coil spring 5 pushes the slider 4 against the lock arm 3 to separate the housings 1, 2. This separating movement provides an indication that the housings 1, 2 were left partly connected.

The housings 1, 2 may be detached from each other for maintenance or another reason, by resiliently deforming the lock arm 3 and pulling the female housing 1. However, the pulling of the female housing 1 may be interrupted inadvertently, and the housings 1, 2 may be left partly connected. A partial connection of the housings during a separating operation cannot be detected in the conventional connectors.

The present invention was developed in view of the above situation and an object of the invention is to enable a partial connection detection both during a connecting operation and during a separating operation.

SUMMARY OF THE INVENTION

The invention is directed a connector with first and second connector housings that are connectable with each other. A slider is assembled with the first connector housing and is movable forward and backward or longitudinally along connecting and separating directions of the housings. The slider is formed to substantially surround at least one outer side surface of the first connector housing, and preferably at least two outer side surfaces thereof. A resilient engaging portion is provided in the second connector housing and is resiliently displaceable from a first position to a second position when the housings are connected properly. The resilient engaging portion preferably is resiliently displaceable in a direction that intersects the connecting and separating directions.

The first connector housing may have a receptacle with a substantially rectangular cross-section and the slider may substantially cover at least one side surface of the receptacle. Alternatively, the connector may have a substantially round, elliptic or rounded configuration, and the slider may cover at least a substantial portion (e.g. more than about half) of the outer circumferential surface of the first connector housing.

The slider preferably is formed into a frame that substantially surrounds all outer side surfaces of the first connector housing. Thus, the outer side surfaces of the first connector housing are in sliding contact with all inner side surfaces of the slider when the slider is moved. Accordingly, the slider moves smoothly and is strong.

The slider preferably comprises at least one operable portion for moving the slider away from the second connector housing and into a position where displacement of the resilient engaging portion to the first position is permitted. The operable portion preferably is exposed to outside. Additionally, the operable portion preferably is spaced back from a leading end of the second connector housing when the connector housings are connected properly.

Two operable portions preferably are at substantially symmetrical positions on the outer surface of the slider. The ability to grip two opposite operable portions contributes further to improved operability of the slider.

The resilient engaging portion preferably is longitudinally engageable with the slider when the resilient engaging portion is in the first position. Additionally, the resilient engaging portion preferably is disengaged longitudinally from the slider when the resilient engaging portion is in the second position.

The slider preferably is engaged with the resilient engaging portion that is located in the first position when the slider is moved away from the second connector housing against a biasing force of a biasing means, both at an intermediate stage of an operation of connecting the connector housings and at an intermediate stage of an operation of separating the connector housings.

The resiliently engaging portion is displaced to the second position and is disengaged longitudinally from the slider when the connector housings are connected properly. Accordingly, the biasing means is released and moves the slider forward toward the second connector housing.

The resilient engaging portion is in the first position at an intermediate stage of the connecting operation and can push the slider back against the biasing force of the biasing means. Biasing forces accumulated in the biasing means are released if the connecting operation is interrupted at this stage. Thus, the slider is biased forward and pushes the resilient engaging portion to separate the connector housings. As a result, partial connection is detected. The resilient engaging portion is disengaged from the slider when the housings are connected properly. Hence, the biasing force accumulated in the biasing means moves the slider forward without separating the housings.

The connector housings can be separated by gripping the operable portion and moving the slider backward against the biasing force of the biasing means. If the separating operation is interrupted halfway, the biasing force accumulated in the biasing means is released and moves the slider forward into engagement with the resilient engaging portion that has been displaced from the second position to the first position. Thus, the connector housings are forcibly separated and a partial connection is detected.

In this way, partial connection can be detected both during the connecting operation and during the separating operation. Further, the operable portion is spaced back from the leading end of the second connector housing, and a space used to operate the slider is provided between the operable portion and the second connector housing. Thus, the operability of the slider during the separating operation can be improved. Furthermore, the slider is formed to surround the first connector housing. Hence, the movement of the slider is smooth, and operability of the slider is improved.

A retainer may be provided for locking terminal fittings in the first connector housing, and the slider may be provided with a detecting portion that allows detection of a mounted state of the retainer. The retainer preferably is insertable into the first connector housing through a retainer insertion portion of the slider. Thus, the mounted state of the retainer is detected when no interference occurs between the retainer and the retainer insertion portion.

The invention also is directed to a method of assembling the connector. The method comprises connecting the first connector housing with the second connector housing for bringing the resilient engaging portion of the second connector housing into engagement with a portion of the first housing to displace the resilient engaging portion from a second position where it is not engageable with the slider along connecting and separating directions of the connector housings to a first position where it is engageable with the slider along the connecting and separating directions.

The slider that is engaged with the resilient engaging portion in the first position is moved back both at an intermediate stage of connecting the connector housings and at an intermediate stage of separating the connector housings. The slider is displaced to the second position when the housings are connected properly, and the resilient engaging portion is not engageable with the slider along the connecting and separating directions. Thus, the slider is moved forward.

The method may further comprise the steps of: mounting a retainer to the first connector housing to lock terminal fittings to the first connector housing, and moving the slider for detecting a mounted state of the retainer.

The method further comprises moving inner surfaces of the slider in sliding contact with the outer surfaces of the first connector housing.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
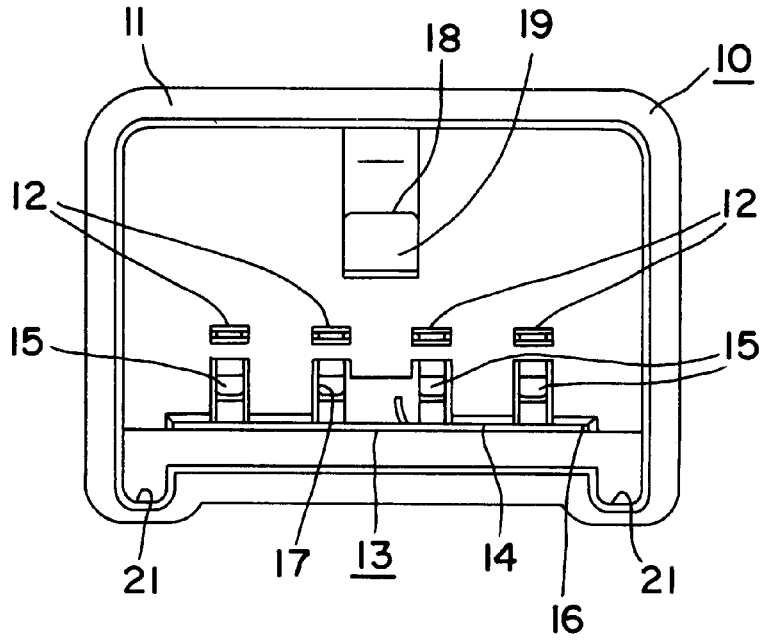
FIG. 1 is a front view of a male housing of a connector according to one embodiment of the invention.
Figure 7:
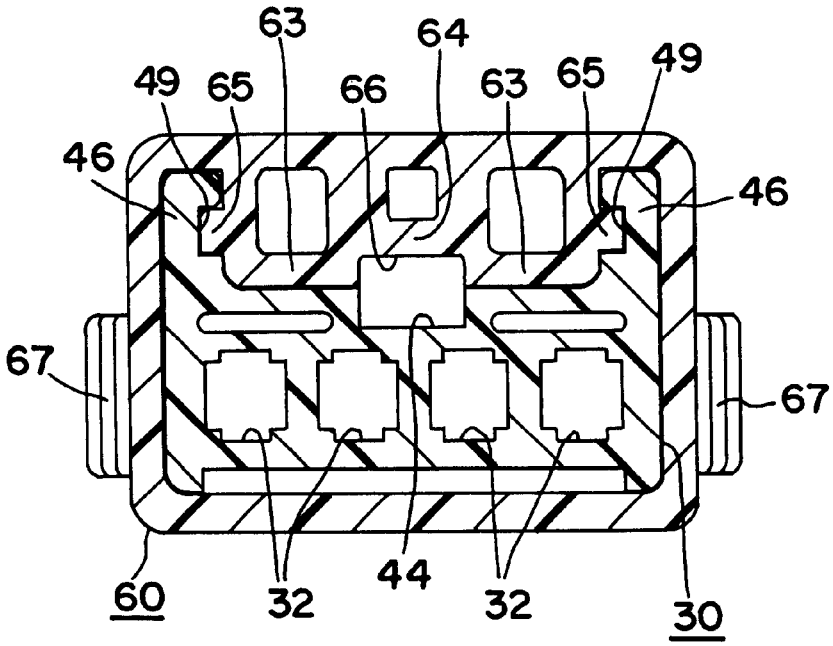
FIG. 7 is a section along 7—7 of FIG. 5B.
Figure 8A:
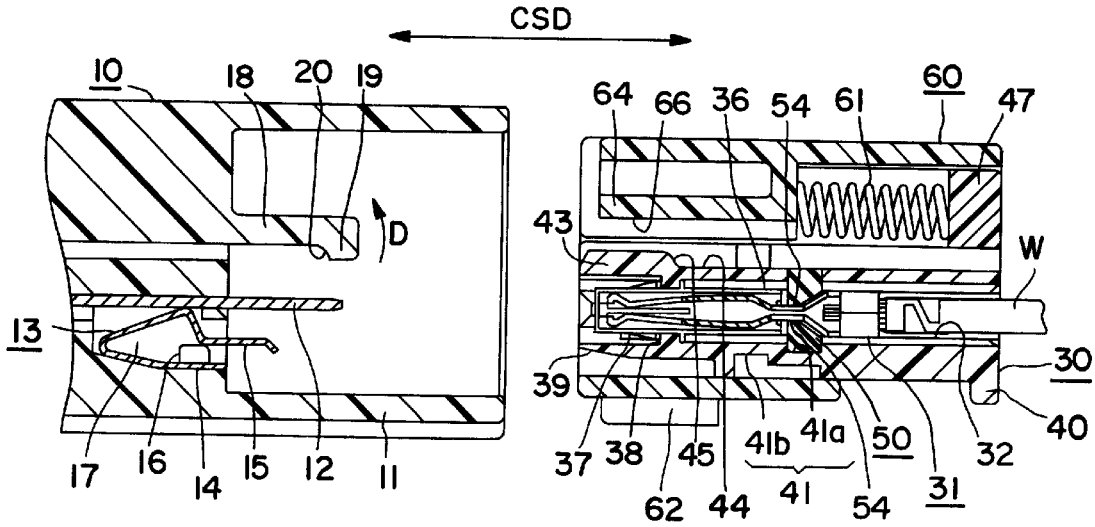
FIGS. 8A and 8B are sections similar to FIGS. 5A and 5B, but showing the female housing having the retainer mounted in a full locking position and sections of the male housing, taken along lines 8A—8A and 8B—8B respectively.
Figure 8B:
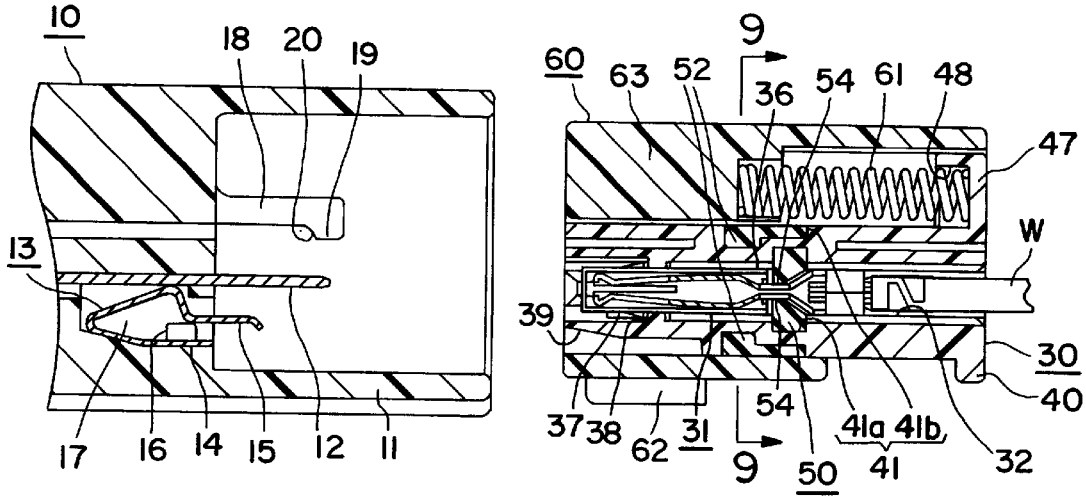

A connector according to the invention is comprised of a male connector housing 10, as shown most clearly in FIGS. 1, 8A and 8B, and a female connector housing 30, as shown in FIGS. 2–15B. In the following description, sides of the housings 10, 30 that are to be connected with each other are referred to as the fronts.

The male housing 10 is formed integrally or unitarily from a synthetic resin, and, as shown in FIGS. 1 and 8, is provided with a rectangular tubular receptacle 11 that projects forwardly from a wall surface of a piece of equipment. Four male tab terminals 12 are arranged substantially side by side and project from a back wall of the male housing 10 into the receptacle 11. Of course, more or fewer male terminals may be provided in other embodiments. A shorting terminal 13 is accommodated in the back wall of the male housing 10 below the male tab terminals 12. The shorting terminal 13 has a substantially plate-shaped main portion 14 pressed into a mount groove 16 in the back wall of the male housing 10. Four resilient contact pieces 15 are folded at the rear end of the main portion 14 to project forward. The resilient contact pieces 15 are accommodated in recesses 17 that face the respective male tab terminals 12, and are held resiliently or elastically in contact with the respective male tab terminals 12. In this way, the four male tab terminals 12 are shorted with each other so that no potential difference exists among them. Front ends of the resilient contact pieces 15 project into the receptacle 11 and are bent down.

A lock arm 18 is cantilevered from a substantially widthwise center position of the back wall of the male housing 10 above from the male tab terminals 12 and projects slightly more forward than the male tab terminals 12. The lock arm 18 is resiliently or elastically deformable about its base end in a direction D along vertical direction in FIGURES. The direction D intersects the connecting and separating directions CSD of the housings 10, 30 at an angle and preferably substantially at a right angle. A hook 19 projects down at the front end of the lock arm 18. Guide recesses 21 are formed at opposite sides of the bottom of the receptacle 11.

Figure 2:
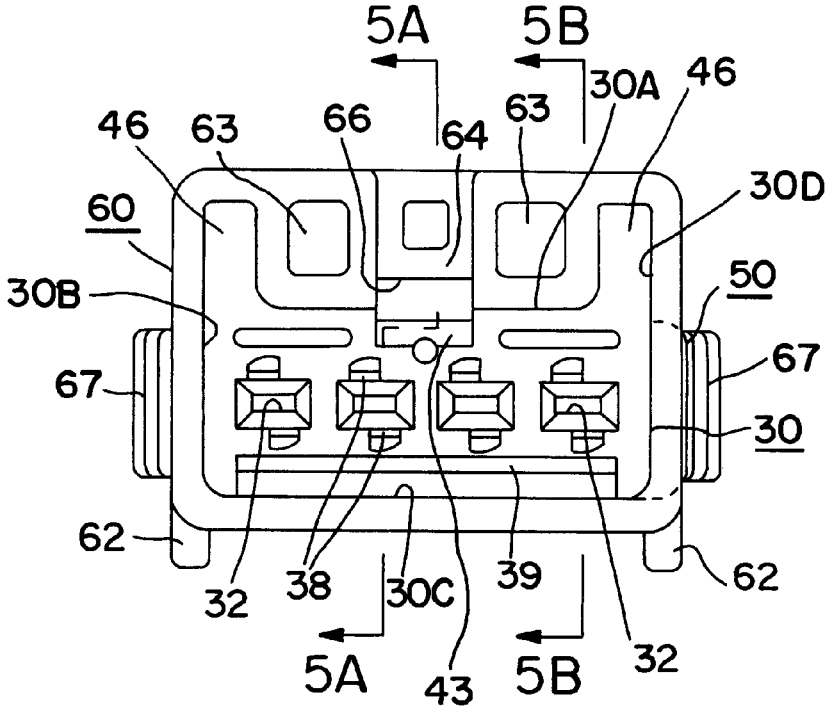
FIG. 2 is a front view of a female housing.
Figure 5A:
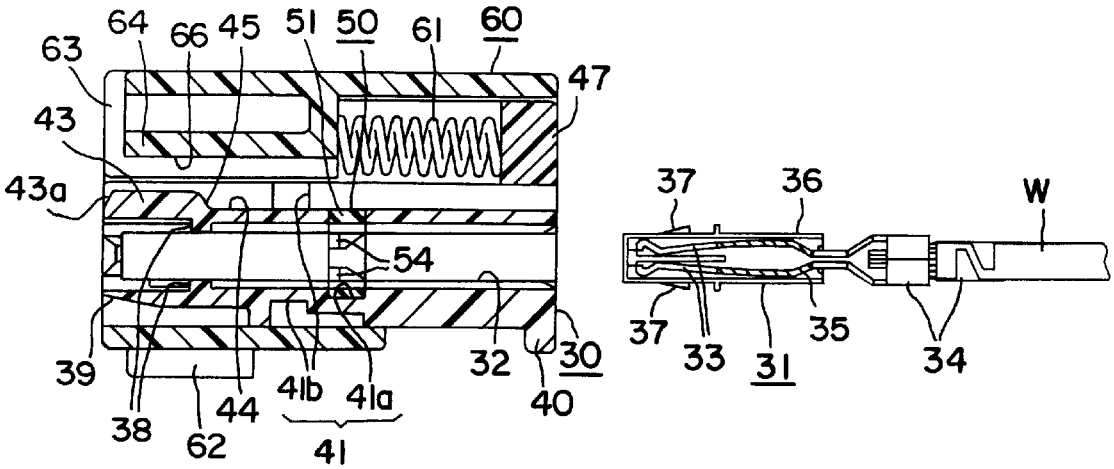
FIGS. 5A and 5B are sections along 5A—5A, 5B—5B of FIG. 2 showing a state where a retainer is mounted in a partial locking position on a female housing, respectively.

The female housing 30 is formed from a synthetic resin into a substantially block shape, as shown in FIGS. 2 and 5(A). Cavities 32 penetrate through the female housing 30 in forward and backward or longitudinal directions and correspond in number to the male tab terminals 12. The cavities 32 are substantially side-by-side in positions that align with the mating male tab terminals 12 when the housings 10, 30 are connected.

Female terminal fittings 31 are connected with ends of wires W and are inserted into the cavities 32. Each female terminal fitting 31 has opposite front and rear ends. A terminal main body 35 is provided at the front end and is formed with a resilient contact piece 33 that can be brought resiliently or elastically into contact with the corresponding male tab terminal 12. A barrel 34 is provided at the rear end of the female terminal fitting 31 for crimped, bent or folded connection with the wire W. A box 36 surrounds the terminal main body 35, and metal locks 37 project from the top and bottom surfaces of the box 36.

Forwardly open locking grooves 38 are formed in the ceiling and bottom surfaces of each cavity 32 and are engageable with the metal locks 37. Engaging recesses 39 are provided along the widthwise direction at the front end of the bottom surface of the female housing 30 and are engageable with the resilient contact pieces 15 of the shorting terminal 13 in the male housing 10. Surfaces of the engaging recesses 39 that engage the resilient contact pieces 15 are sloped down and away from the female terminal fittings 31 to the right in FIG. 5. Thus, the resilient contact pieces 15 are smoothly deformable down and away from the female terminal fittings 31. A rib 40 extends along the widthwise direction at the rear end of the bottom surface of the female housing 30. The female housing 30 is pushed at a position near the rear end surface of the rib 40 to be connected with the male housing 10.

Figure 3:
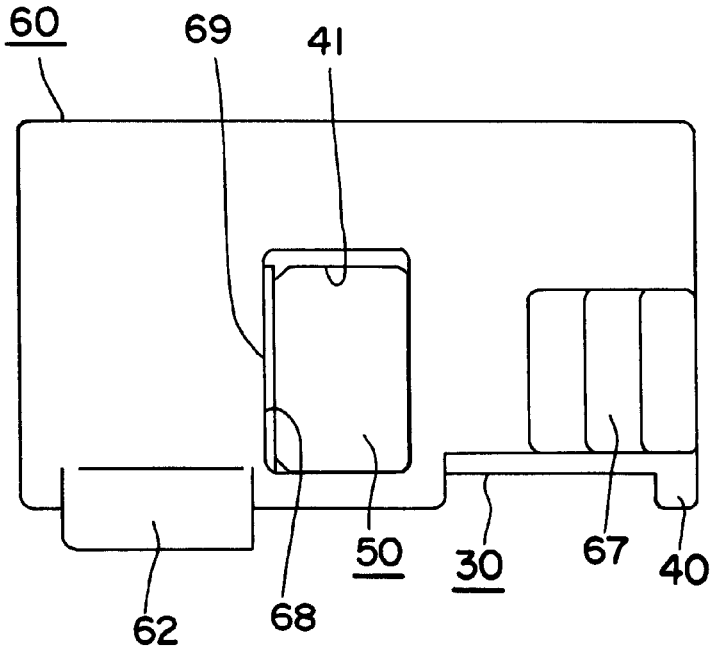
FIG. 3 is a side view of the female housing.

A retainer mount hole 41 is formed substantially at a longitudinal center of a side surface of the female housing 30, as shown in FIGS. 3 and 5(A). The retainer mount hole 41 communicates with the cavities 32, and is comprised of a base inserting portion 41*a* and holding arm inserting portions 41*b*, which are recessed from the top and bottom surfaces of the female housing 30. Holding projections 42 are formed on the outer surfaces of the holding arm inserting portions 41*b* of the retainer mounting hole 41.

Figure 6:
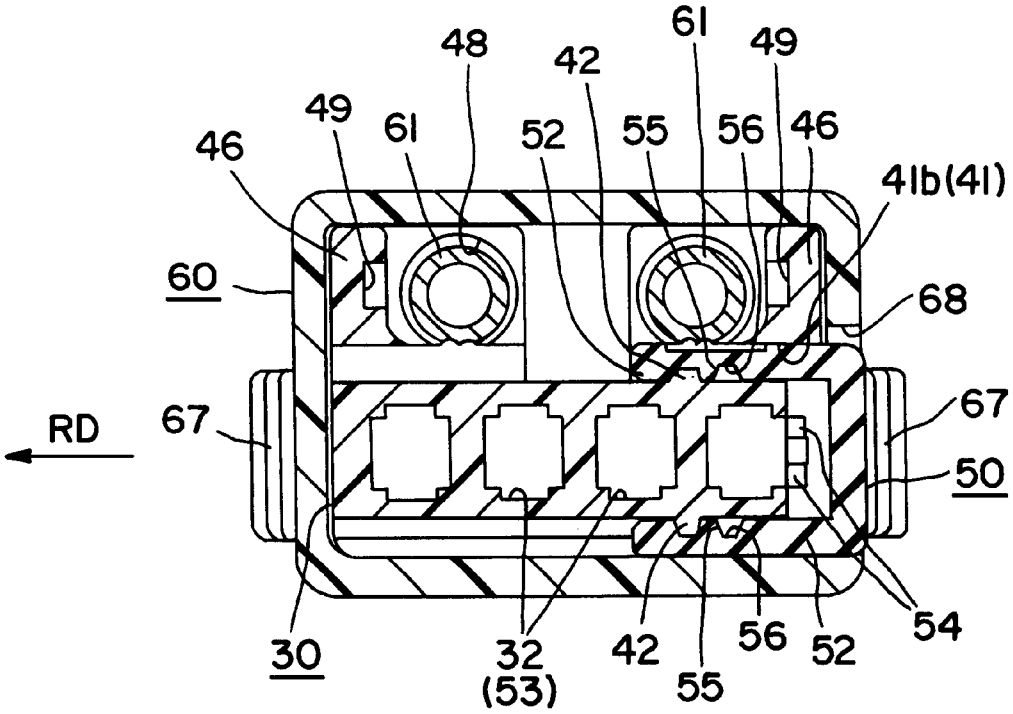
FIG. 6 is a section along 6—6 of FIG. 5B.
Figure 9:
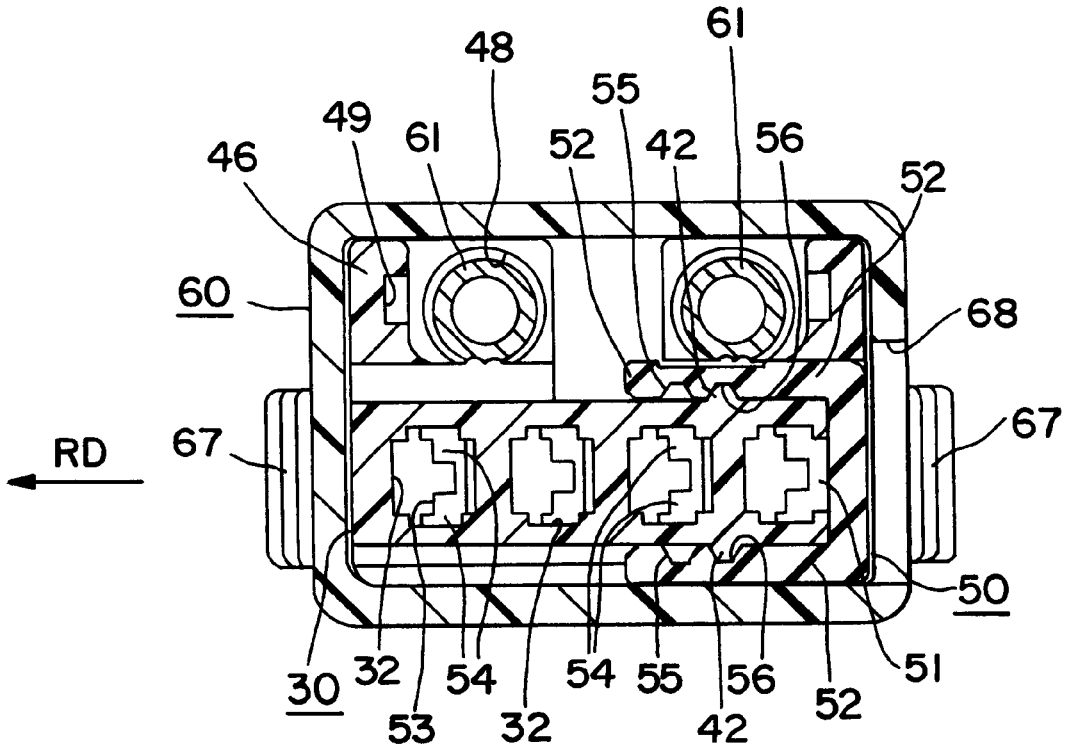
FIG. 9 is a section along 9—9 of FIG. 8B.

A retainer 50 can be accommodated in the retainer mount hole 41. The retainer 50 includes a substantially planar base 51 that can be inserted into the base inserting portion 41*a* and two holding arms 52 that can be inserted the arm inserting portions 41*b*. As shown in FIG. 6, the planar base 51 of the retainer 50 has substantially the same length as the width of the female housing 30. The holding arms 52 extend from the upper and bottom surfaces of the base 51 substantially parallel to the base 51. The base 51 has four insertion holes 53 substantially aligned with the respective cavities 32. Upper and lower locks 54 are formed at the front edge of each insertion hole 53 with respect to a mounting direction of the retainer 50, as shown in FIG. 9, and are engageable with the rear end of the box 36 of the corresponding female terminal fitting 31. Two holding recesses 55, 56 are formed side by side in widthwise direction (mounting direction RD of the retainer 50) in the inner surface of each holding arm 52. The retainer 50 can be held at a partial locking position and a full locking position by engaging the holding recesses 55, 56 with the holding projections 42 on the outer surfaces of the holding arm inserting portions 41*b* of the retainer mount hole 41. Thus, the retainer 50 is movable between these two positions along the mounting direction RD of the retainer 50, which is at a right angle to the insertion/withdrawal direction of the female terminal fittings 31 into/from the female connector housing 30.

The retainer 50 is held in the partial locking position by engaging the holding projections 42 in the holding recesses 55 at the back side with respect to the mounting direction RD of the retainer 50. In this partial locking position, the insertion holes 53 communicate with the cavities 32 and the locking portions 54 are retracted from the cavities 32 as shown in FIGS. 5 and 6, thereby permitting insertion and withdrawal of the female terminal fittings 31 into and from the cavities 32. At this stage, a front end of the retainer 50 with respect to its mounting direction RD projects from the outer surface of the female housing 30, as shown in FIG. 6. The retainer 50 is held in the full locking position by engaging the holding projections 42 in the holding recesses 56 at the front side with respect to the mounting direction RD of the retainer 50. In this full locking position, the locking portions 54 project into the cavities 32 and engage the rear ends of the box portions 36 of the female terminal fittings 31, as shown in FIGS. 8 and 9, to prevent the female terminal fittings 31 from coming out. At this stage, the front end of the retainer 50 with respect to its mounting direction is in the retainer mount hole 41, and the outer surface thereof is substantially flush with the outer surface of the female housing 30, as shown in FIG. 9. Accordingly, the female terminal fitting 31 is locked doubly in the cavities 32 by the retainer 50.

A lock 43 is formed at a substantially widthwise center of the upper surface of the female housing 30, and a locking groove 44 extends back from the lock 43, as shown in FIG. 5(A). A slanted or rounded surface 43*a* is formed on the front of the lock 43 for guiding the lock arm 18 onto the lock 43. Thus, the lock arm 18 of the male housing 10 deforms resiliently and moves onto the lock 43 as the housings 10, 30 are fitted together. The upper surface of the lock 43 is substantially at the same height as the lower surface of the lock arm 18 rearward of the hook 19. Thus, when the housings 10, 30 are connected to a proper depth, the hook 19 of the lock arm 18 enters the locking groove 44 and the rear surface 20 of the hook 19 engages a rear surface 45 of the lock 43. The rear surface 20 of the hook 19 and the rear surface 45 of the lock 43 are sloped moderately upward to the left in FIGURES, thereby forming a releasable locking construction. Thus, the lock arm 18 will be guided by the slanted rear surfaces 20, 45 and will deform resiliently up and out of the locked state in response to a specified force that acts to separate the housings 10, 30 from each other when the hook 19 is engaged with the lock 43. Further, the holding arm inserting portion 41*b* of the retainer mount hole 41 communicates with the locking groove 44, as shown in FIG. 8. The hook 19 of the lock arm 18 enters the locking groove 44 when the housings 10, 30 are connected properly with each other and does not interfere with the holding arm 52 of the retainer 50 entering the locking groove 44 in the full locking position (see FIG. 12).

Figure 4:
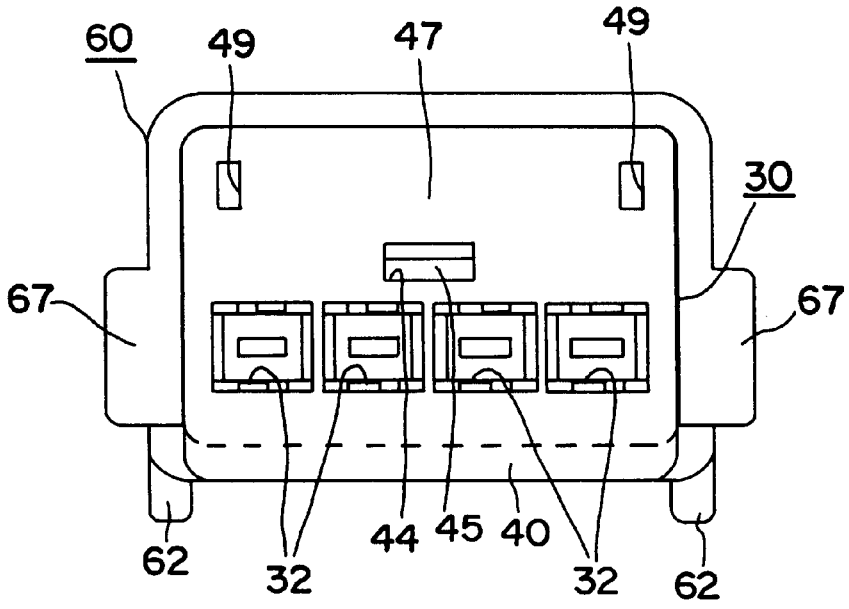
FIG. 4 is a rear view of the female housing.

The female housing 30 has an upper surface 30A, a first outer side surface 30B, a lower surface 30C and a second outer side surface 30D. Side walls 46 project up from the upper surface 30A of the female housing 30 adjacent the outer side surfaces 30B and 30D, as shown in FIGS. 2, 6 and 7, and extend in forward and backward directions over substantially the entire length of the female housing 30. A rear wall 47 is connected with the side walls 46 and projects up at the rear end of the female housing 30, as shown in FIGS. 4 and 5. Longitudinally extending stopper grooves 49 are formed in the inner surfaces of the side walls 46, as shown in FIG. 6.

A substantially frame-shaped slider 60 is made e.g. of a synthetic resin, and is configured to surround most or all of the outer surfaces 30A–30D of the female housing 30, as shown in FIGS. 2 and 4. Additionally, the slider 60 has a length substantially equal to the length of the female housing 30, as shown in FIG. 3. The slider 60 is movable forward and back along the connecting and separating directions CSD of the housings 10, 30, with the inner surfaces of the frame-shape slider 60 in sliding contact with the outer surfaces 30A–D of the female housing 30. Compression coil springs 61 are disposed between the slider 60 and the rear wall 47 of the female housing 30 to bias the slider 60 forwardly. Two guide ribs 62 project at opposite bottom side edges of the slider 60, as shown in FIG. 2, and enter the guide recesses 21 of the male housing 10 for guiding the movement of the slider 60. A lower portion of the slider 60 behind the retainer 50 is cut away, as shown in FIG. 3 to avoid interference with the rib 40 of the female housing 30 during the movement of the slider 60.

Figure 5B:
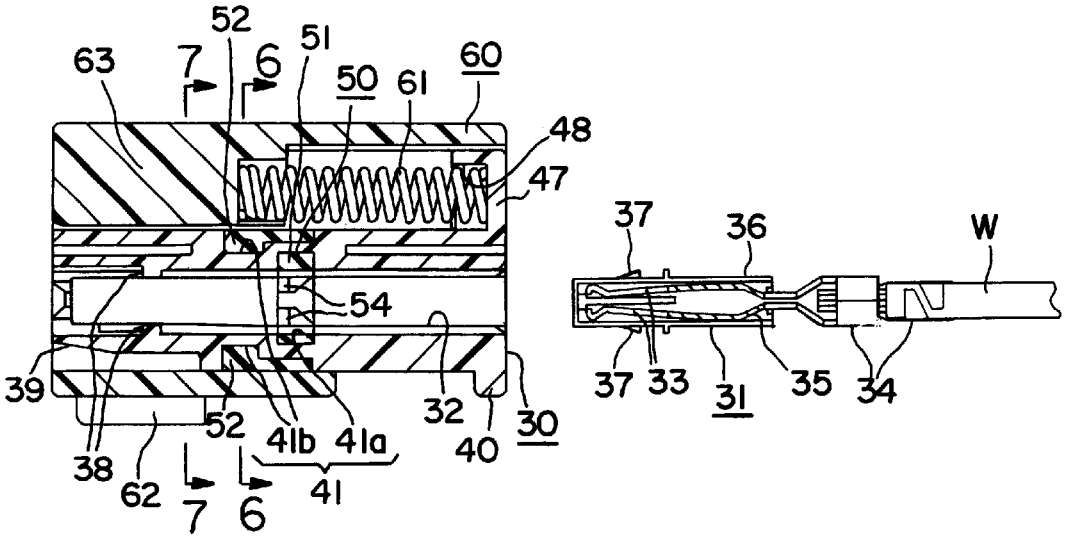

A bulge projects in on the slider 60 at a location between the opposite side walls 46, as shown in FIG. 2. The bulge defines spring pressing portions 63 adjacent the respective side walls 46 and an engageable portion 64 between the spring pressing portions 63. The spring pressing portions 63 have recessed rear end surfaces, as shown in FIG. 5(B), to support the front ends of the coil springs 61. Rear ends of the coil springs 61 are disposed in spring accommodating recesses 48 in the rear wall 47 of the female housing 30, such that the springs 61 are slightly compressed between the spring pressing portions 63 and the rear wall 47. The side surfaces and the bottom surfaces of the spring pressing portions 63 are held near or in contact with the inner side surfaces of the side walls 46 and the upper surface of the female housing 30, as shown in FIG. 2. Stopper projections 65 project outwardly from the side surfaces of the spring pressing portions 63 and are engaged in the stopper grooves 49, as shown in FIG. 7. The front ends of the stopper grooves 49 limit forward movement of the slider 60 on the female housing 30.

Figure 10A:
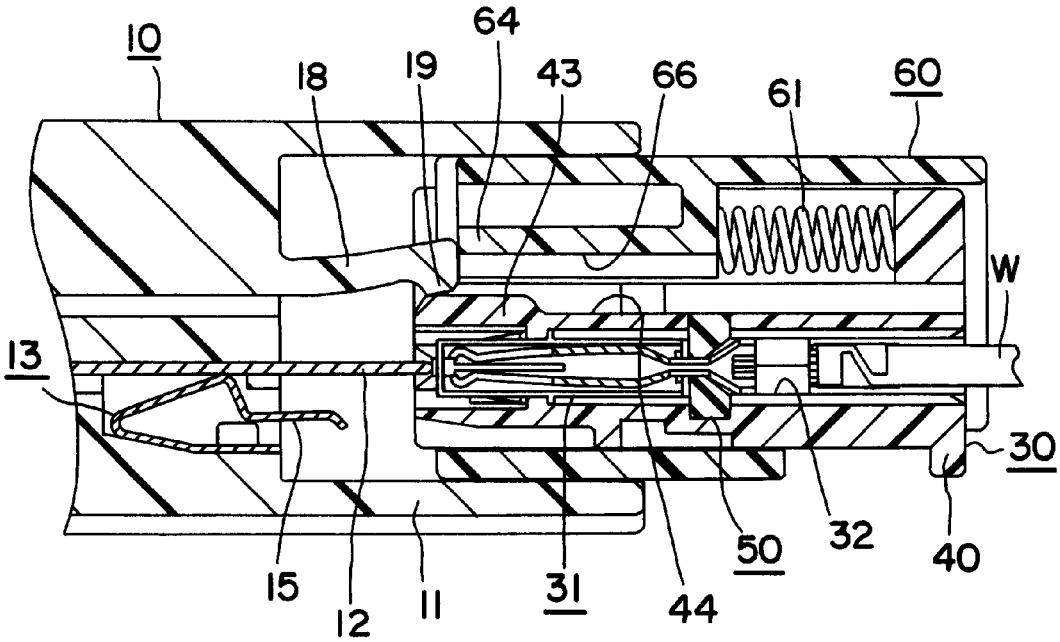
FIGS. 10A and 10B are sections similar to FIGS. 8A and 8B, but showing a state where a lock arm is resiliently deformed to engage a slider at an intermediate stage of connection of the housings, respectively.
Figure 12A:
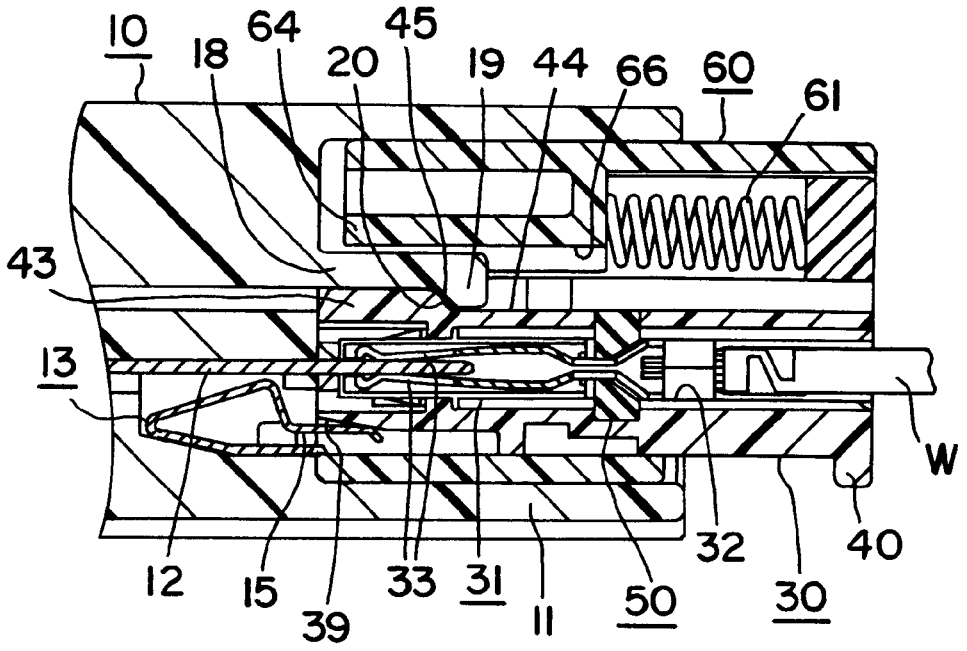
FIGS. 12A and 12B are sections similar to FIGS. 11A and 11B, but showing a state where the housings are properly connected.

The engageable portion 64 has a front end surface disposed rearwardly of the front end surfaces of the spring pressing portions 63, as shown in FIG. 5(A). The front end surface of the lock arm 18 engages the engageable portion 64 at an intermediate stage of connection of the housings 10, 30. An escape recess 66 is formed in the bottom of the engageable portion 64 to define a space above the upper surface of the female housing 30. The upper surface of the escape recess 66 is slightly higher than the upper surface of the lock arm 18 in its natural state as shown in FIG. 8(A). Accordingly, the lock arm 18 is deformed resiliently so that the hook 19 moves onto the lock 43 during the connection of the housings 10, 30 and the engageable portion 64 is engageable with the front end surface of the hook 19 in an engaging or first position, as shown in FIG. 10(A). The hook 19 moves reward of the lock 43 when the housings 10, 30 are connected properly. As a result, the lock arm 18 is moved resiliently or elastically substantially to its natural state and into a disengaging or second position relative to the engageable portion 64, as shown in FIG. 12(A). As shown in FIG. 2, cut-away portions are formed in the centers of the front end surfaces of the engageable portion 64 and the spring pressing portions 63, and are open forward.

Figure 13:
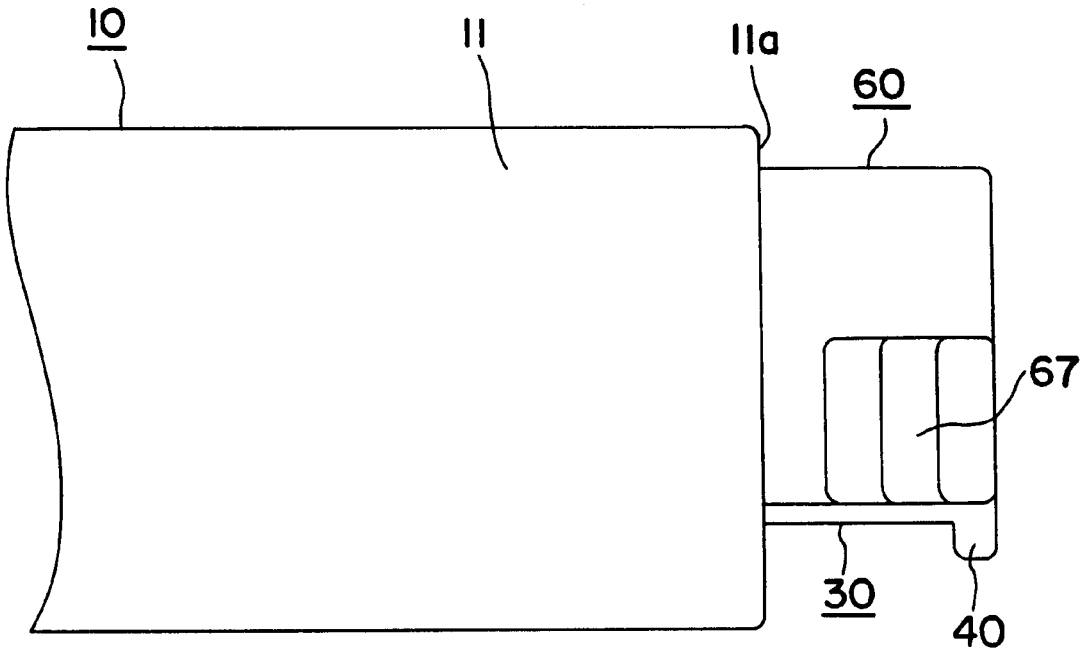
FIG. 13 is a side view showing the state of FIG. 12.
Figure 14A:
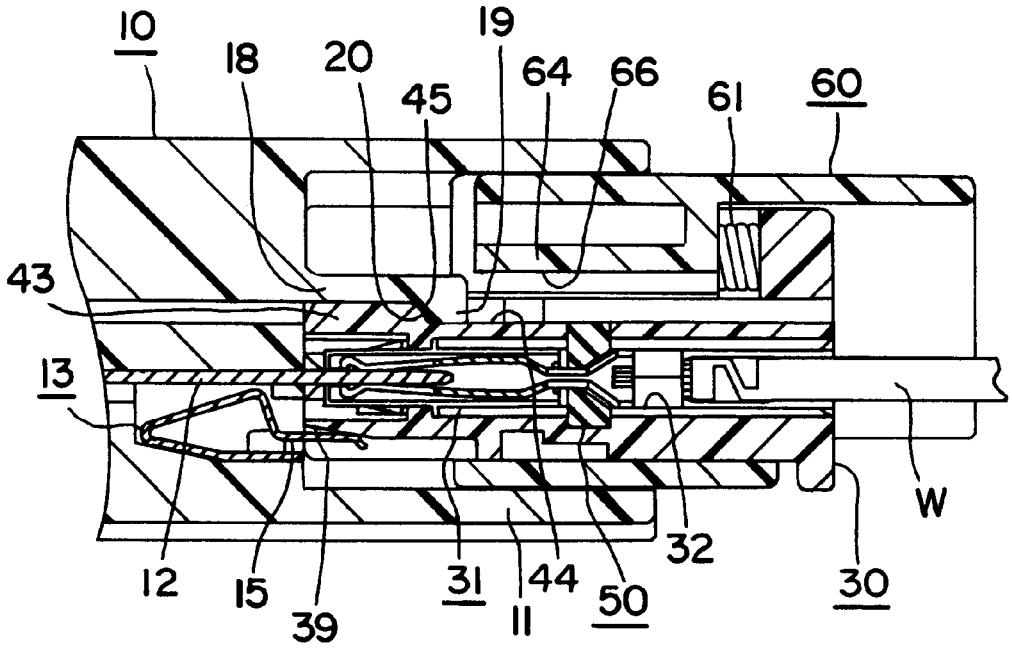
FIGS. 14A and 14B are a sections similar to FIGS. 12A and 12B, but showing a first stage of separation.
Figure 14B:
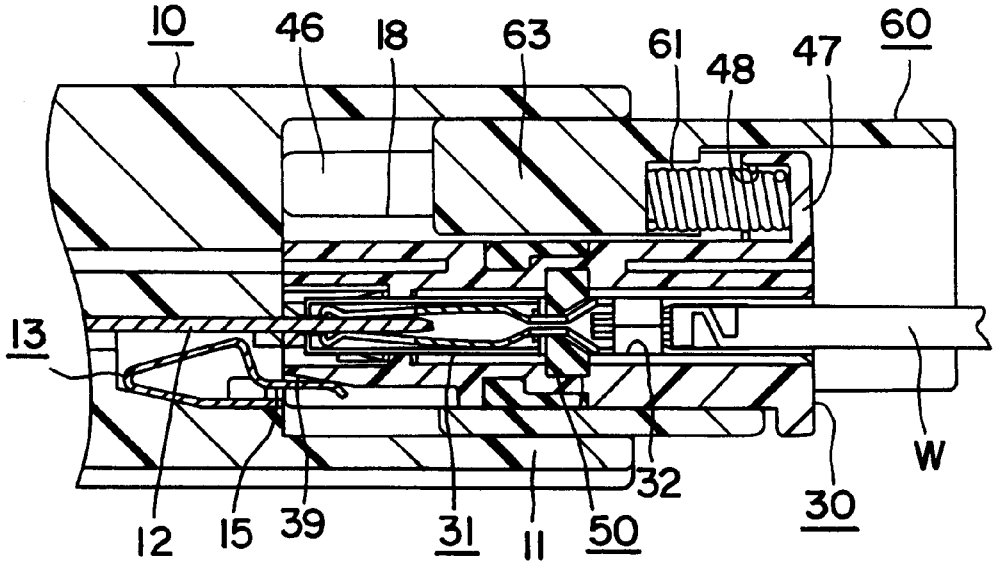

Operable portions 67 project sideways from the rear ends of the opposite outer side surfaces of the slider 60, as shown in FIGS. 2, 3 and 4, and are used to move the slider 60 back and away from the male connector housing 10. The operable portions 67 are at substantially the same height as the cavities 32 and extend oppositely away from one another at symmetrical positions on the outer side surfaces of the slider 60 so that an operator may hold the operable portions 67 with fingers of one hand. Each operable portion 67 has three steps that project out to larger degrees toward the back. The rear disposition ensures that the operable portions 67 are spaced back from the front end surface 11*a* of the receptacle 11 of the male housing 10 by a specified distance, as shown in FIG. 13, when the housings 10, 30 are connected properly with each other. Therefore, a space can be provided between the operable portions 67 and the male housing 10 so that fingers can easily be placed on the operable portions 67 when they are operated.

A retainer insertion hole 68 is formed in a portion of the slider 60 covering the surface of the female housing 30 that has the retainer mounting hole 41. Thus, the retainer insertion hole 68 exposes the retainer mounting hole 41, as shown in FIG. 3, and enables insertion of the retainer 50 into the retainer mounting hole 41 with the slider 60 assembled on the female housing 30. The retainer insertion hole 68 is a substantially rectangular window and is slightly wider than the retainer mount hole 41. The front end of the retainer 50 projects from the side surface of the female housing 30 and into the retainer insertion hole 68, as shown in FIG. 6, when the retainer 50 is in the partial locking position. Thus, the front edge 69 of the retainer insertion hole 68 interferes with the projecting portion of the retainer 50 and restricts movement of the slider 60, if an attempt is made to move the slider 60 backward in this state. On the other hand, the retainer 50 is accommodated completely in the retainer mounting hole 41 and is no longer in the retainer insertion hole 68 when the retainer is moved to the full locking position, as shown in FIG. 9. Backward movement of the slider 60 is permitted since the front edge 69 of the retainer insertion hole 68 does not interfere with the retainer 50. Therefore, the mounted state of the retainer 60 can be detected based on whether the backward movement of the slider 60 is permitted, and the front edge 69 of the retainer insertion hole 68 serves as a detector.

The compression coil springs 61 are inserted into the spring accommodating recesses 48 of the female housing 30 from the front and the slider 60 is assembled with the female housing 30 from front, as shown in FIG. 5(B). This rearward movement of the slider 60 causes the stopper projections 65 to enter the stopper grooves 49 and move in sliding contact with the inner side surfaces of the side walls 46. The stopper projections 65 engage the front end surfaces of the stopper grooves 49 when the slider 60 reaches a proper position where the front and rear end surfaces of the slider 60 align with the front and rear surfaces of the female housing 30. As a result, the slider 60 is held at its front limit position. At this stage, the retainer insertion hole 68 substantially aligns with the retainer mounting hole 41, as shown in FIG. 3.

The retainer 50 then is mounted through the retainer insertion hole 68 of the slider 60 and is moved into the partial locking position in the retainer mounting hole 41, as shown in FIGS. 5 and 6. The female terminal fittings 31 connected with the wires W then are inserted into the cavities 32 from behind until the metal locks 37 engage the rear end surfaces of the locking grooves 38 to partly lock the female terminal fittings 31, as shown in FIG. 8. The retainer 50 is pushed to the full locking position by inserting a finger, a jig or the like into the retainer insertion hole 68 after all the female terminal fittings 31 are inserted. The locking portions 54 then directly engage the rear end surfaces of the box portions 36 of the female terminal fittings 31, as shown in FIGS. 8 and 9, to lock the female terminal fittings 31 fully.

Figure 10B:
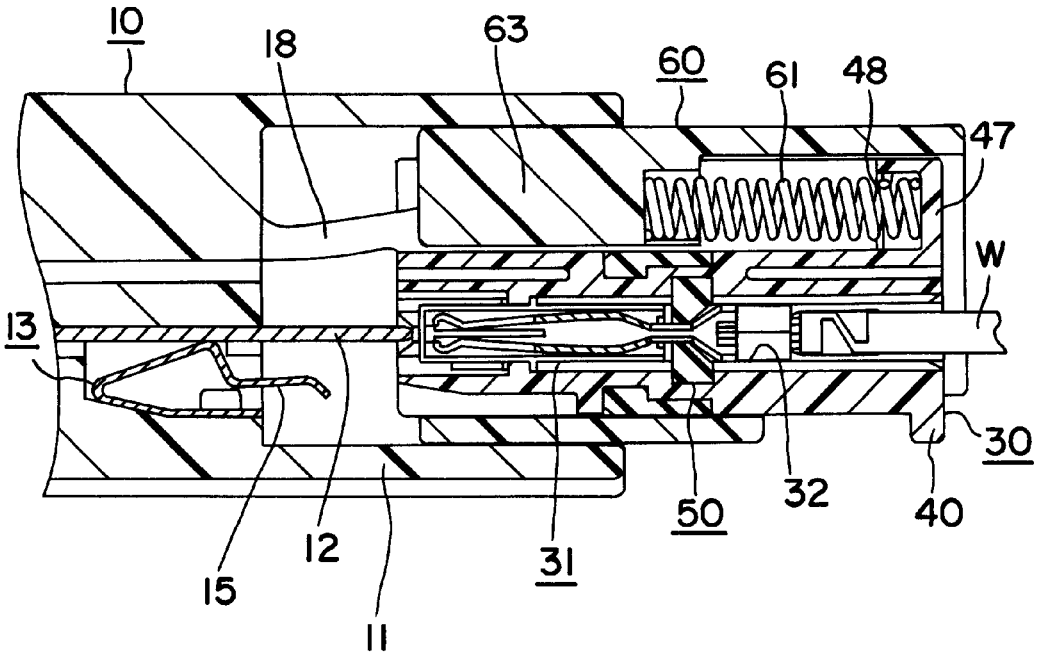

The housings 10, 30 are connected with each other after the female housing 30 is assembled completely. More particularly, the female housing 30 and the slider 60 are fitted into the receptacle 11 of the male housing 10 from the front by pushing the female housing 30 near the rib 40. The guide ribs 62 of the slider 60 then enter the guide recesses 21 of the receptacle 11 to guide the connecting operation. The lock arm 18 engages the slanted front end surface 43*a* of the lock 43 before the male tab terminals 12 project into the cavities 32 of the female housing 30. As a result, the lock arm 18 is deformed resiliently to the engaging position and moves onto the lock 43 as shown in FIG. 10. The lock arm 18 stays in the engaging position and engaged with the engageable portion 64 of the slider 60 as the connection proceeds. Thus, the slider 60 is pushed backward by the lock arm 18.

The retainer 50 could have been pushed insufficiently or an operation of pushing the retainer 50 could have been forgotten. In this situation, the front edge 69 of the retainer insertion hole 68 of the slider 60 interferes with the front end of the retainer 50, thereby restricting the backward movement of the slider 60. As a result, the connecting operation of the housings 10, 30 is hindered. If the connecting operation is hindered, the female housing 30 is pulled out of the male housing 10, the retainer 50 is pushed to the full locking position to lock the female terminal fittings 31 securely and the connecting operation is resumed. Insufficient insertion of the retainer 50 also may be detected by checking whether the slider 60 can be moved back before the connecting operation is started, thereby avoiding interruption of the connecting operation.

Figure 11A:
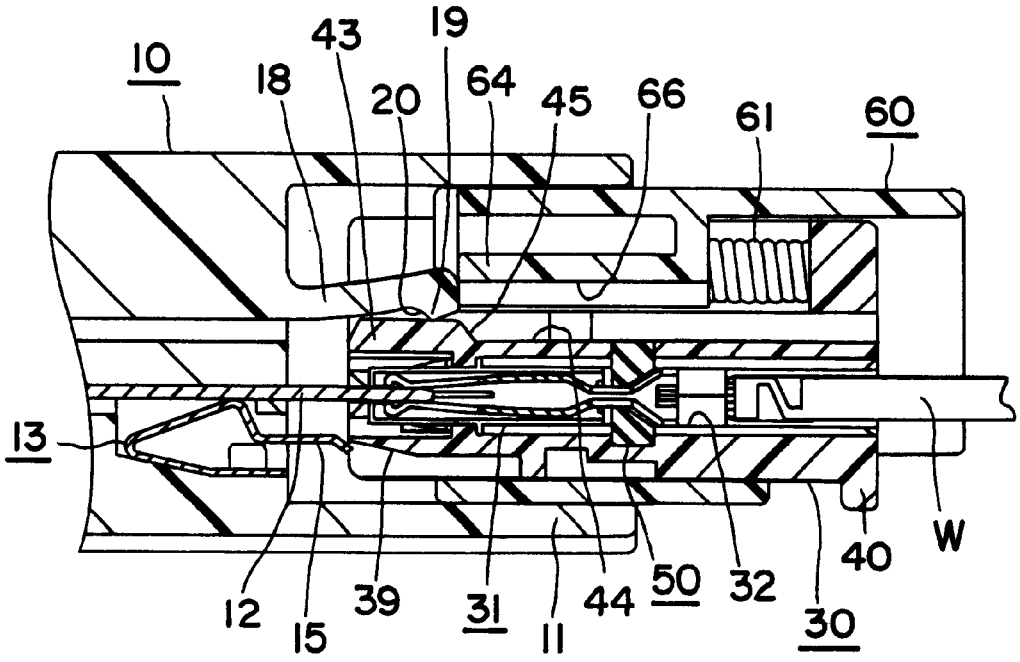
FIGS. 11A and 11B are sections similar to FIGS. 10A and 10B, but showing a state where the slider is moved backward by the lock arm, and where compression coil springs are resiliently compressed.
Figure 11B:
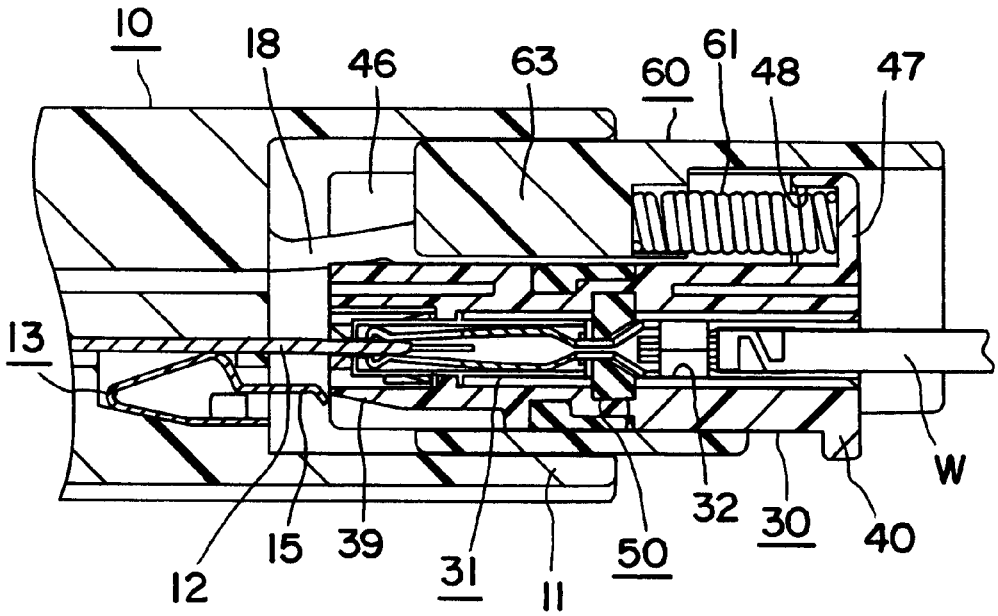

The slider 60 can be pushed back by the lock arm 18 against biasing forces of the compression coil springs 61 if the retainer 50 is in the full locking position, as shown in FIG. 11. However, the connecting operation could be interrupted at an intermediate stage of connection. In this situation, spring forces accumulated in the compressed coil springs 61 are released and the lock arm 18 is pushed by the forwardly biased slider 60 to separate the housings 10, 30. Thus, the housings 10, 30 are not left partly connected.

Figure 12B:
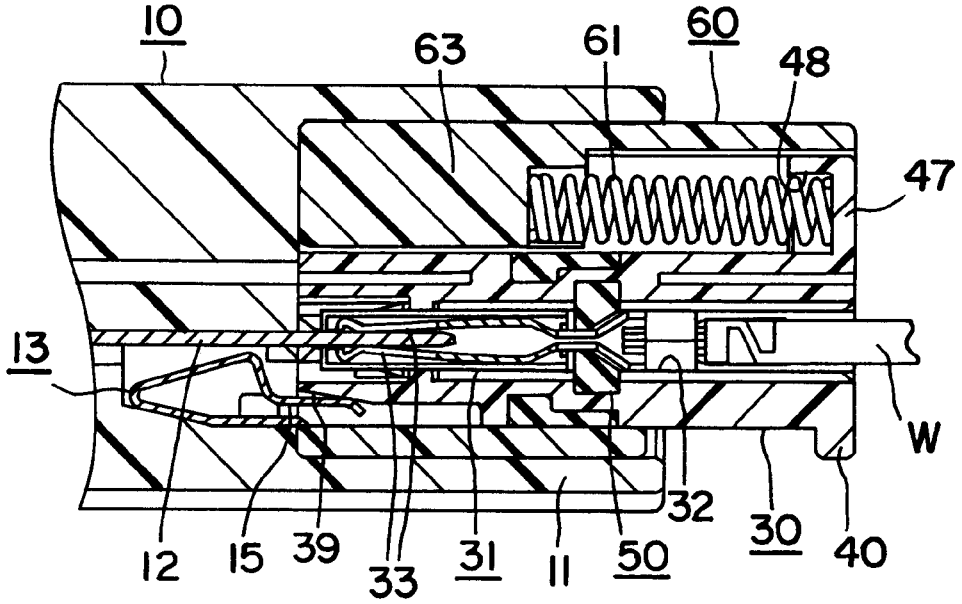

The engaging recesses 39 of the female housing 30 engage the resilient contact pieces 15 of the shorting terminal 13 as the connecting operation continues. Thus, the resilient contact pieces 15 are deformed down and away from the male tab terminal 12 and the shorted state of the male tab terminals 12 is canceled (see FIG. 12). The terminal fittings 12, 31 are connected electrically when the housings 10, 30 are connected to proper depth. At the same time, the lock arm 18 is restored resiliently and the hook 19 of the lock arm 18 enters the locking groove 44. As a result, the rear surfaces 20, 45 of the hook 19 and the lock 43 engage, as shown in FIG. 12. The lock arm 18 thus is in the disengaging position where no engagement exists between the lock arm 18 and the slider 60 along the connection and disconnection direction CSD. This releases the spring forces accumulated in the compression coil springs 61 and propels the slider 60 forward to the front limit position where the stopper projections 65 engage the front end surfaces of the stopper grooves 49. The lock arm 18 then escapes into the escape recess 66 and the engageable portion 64 is above the lock arm 18 over substantially its entire length to prevent the lock arm 18 from being deformed up and away from the lock 43. In this way, the housings 10, 30 are locked firmly together because the lock arm 18 and the lock 43 are engaged and the lock arm 18 is prevented from being deformed in the unlocking direction by the slider 60. At this stage, the operable portions 67 of the slider 60 are spaced back from the front end surface of the male housing 10 by a specified distance.

Figure 15A:
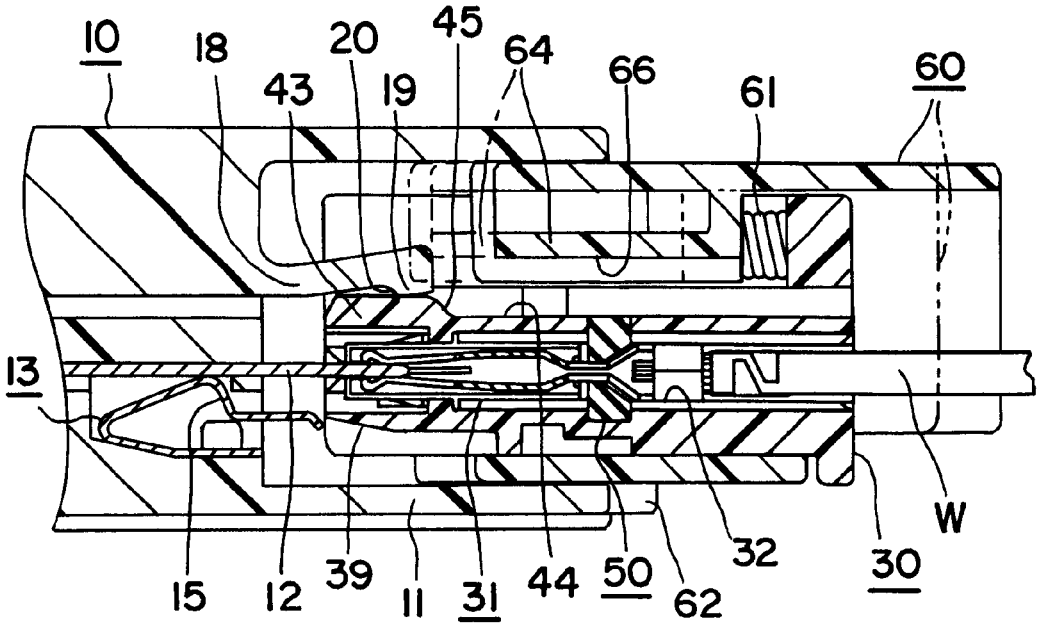
FIGS. 15A and 15B are sections similar to FIGS. 14A and 14B, but showing an intermediate stage of separation of the two housings, respectively.
Figure 15B:
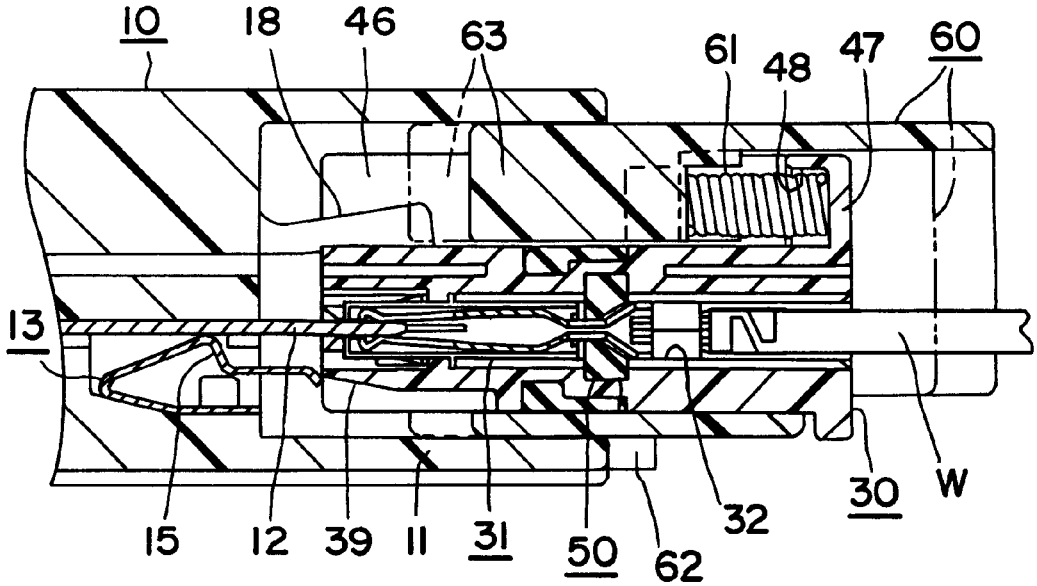
Figure 16:
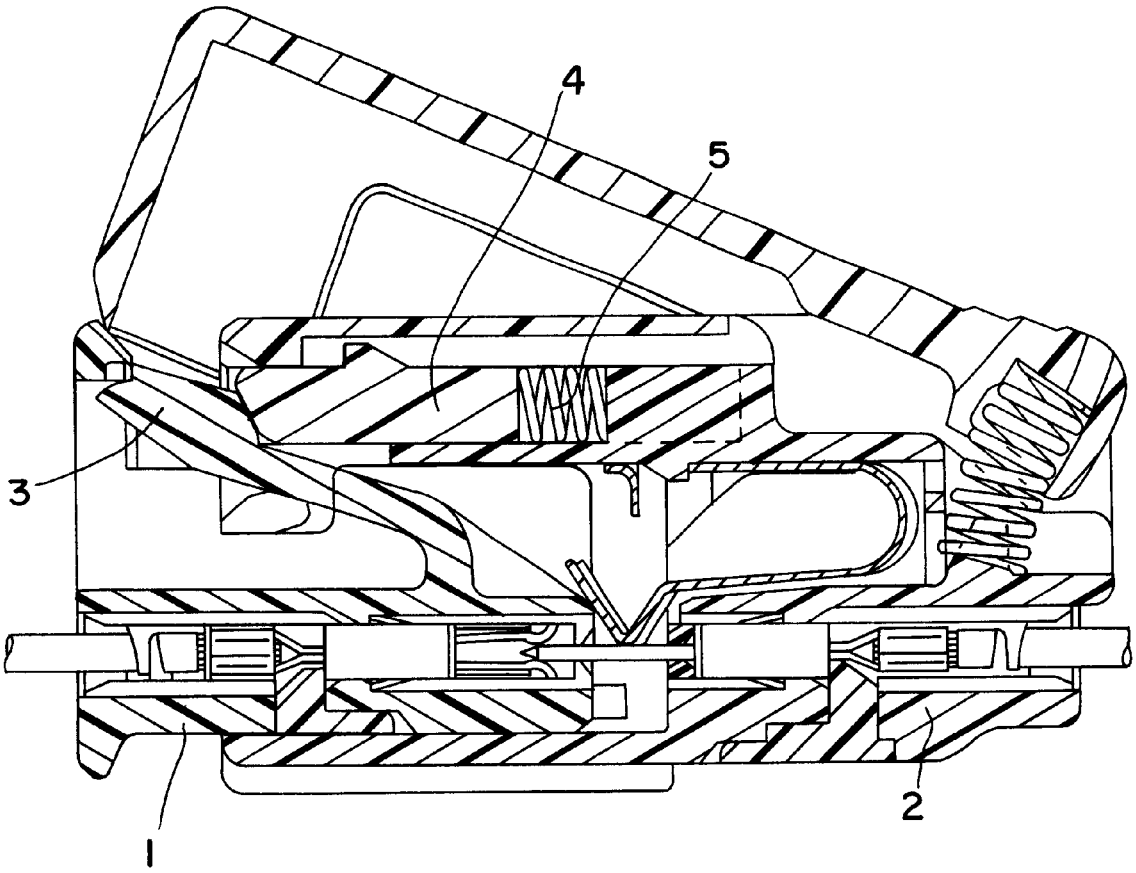
FIG. 16 PRIOR ART
FIG. 16 is a side view in section of a prior art connector.

The housings 10, 30 may require separation for maintenance or for another reason. In such cases, the fingers of one hand grip the exposed operable portions 67 of the slider 60 and move the slider 60 back against the biasing forces of the compression coil springs 61. The space between the operable portions 67 and the male housing 10 ensures convenient manual gripping of the operable portions 67, and enables the slider 60 to be operated easily. The slider 60 eventually reaches the position shown in FIG. 14 where the engageable portion 64 is no longer above the lock arm 18. Thus, further pulling forces on the slider 60 in the separating direction cause sliding movement between the slanted rear end surfaces 20, 45 of the hook 19 and the lock 43 and hence cause the lock arm 18 to deform resiliently into the engaging position, as shown in FIG. 15. Pulling the slider 60 further from this state separates the female housing 30 from the receptacle 11 of the male housing 10. The resilient contact pieces 15 of the shorting terminal 13 disengage from the engaging recesses 39 as the housings 10, 30 are separated and move resiliently back into contact with the respective male tab terminals 12. The pulling direction of the slider 60 coincides with the separating direction of the female housing 30 from the male housing 10. Thus, the housings 10, 30 can be separated easily merely by pulling the operable portions 67 of the slider 60 in the separating direction.

The separating operation may be interrupted halfway for some reason. In such a case, the spring forces accumulated in the compression coil springs 61 are released and move the slider 60 forward. Thus, the engageable portion 64 of the slider 60 strikes the front face of the lock arm 18 in the engaging position, as shown in FIG. 15, and forcibly separates the housings 10, 30. On the other hand, the separating operation may be interrupted with the female housing 30 only slightly moved in the separating direction from its connected state with the male housing 10. In this situation, the forwardly biased slider 60 strikes against the rounded upper front end of the lock arm 18 while the lock arm 18 is deformed slightly, thereby guiding the lock arm 18 to its disengaging position and returning the housings 10, 30 to the connected state. In such a case, the separating operation is performed again, and the housings 10, 30 are not left partly connected during the separating operation.

As described above, partial connection of the housings 10, 30 can be detected both during a connecting operation and during a separating operation. Further, the operable portions 67 are spaced back from the front end of the male housing 10 to define a space for placing fingers during the separating operation. Thus, efficient operability of the slider 60 is achieved.

The slider 60 defines a frame shape that surrounds the exterior of the female housing 30. Thus, the inner surface of the slider 60 is in sliding contact with substantially the entire outer surface 30A–D of the female housing 30 during the movement of the slider 60. Thus, the slider 60 operates smoothly and is strong.

The operable portions 67 are provided symmetrically on the outer side surfaces of the slider 60. Thus, the slider 60 can be operated easily merely by gripping the operable portions 67.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The operable portions 67 are at symmetrical positions on the outer side surfaces of the slider 60 in the foregoing embodiment. However, the positions can be changed, provided they are back from the front end surface 11*a* of the male housing 10 when the housings 10, 30 are properly connected with each other. Further, more or fewer operable portions 67 may be provided.

The slider 60 is formed into a frame shape that substantially surrounds the female housing over substantially the entire circumference in the foregoing embodiment. However, the slider 60 may be formed into a channel that surrounds three sides of the female housing or a L-shape that surrounds two sides of the female housing according to the present invention.

Although the compression coil springs 61 are mounted behind the slider 60 in the foregoing embodiment, tension coil springs may be mounted before the slider 60 according to the present invention.

Contrary to the foregoing embodiment, the slider 60 and the compression coil springs 61 may be mounted in the male housing 10 and the lock arm 18 may be in the female housing 30.

Although the male housing 10 is formed with a piece of equipment in the foregoing embodiment, it may be mountable on an end of a wire drawn out from the equipment or may be an intermediate connector.

Biasing means such as resilient rods, plate-like springs, etc. can be used in place of the compression coil springs 61.

The invention also is applicable to connectors having a substantially round, elliptic or rounded cross section. In this case, the slider covers more than about 50%, and preferably more than 70% of the outer circumferential surface of the first connector housing of the connector. Most preferably, the slider substantially covers the full or complete circumferential surface of the first connector housing.

What is claimed is:

1. A connector, comprising:

a first connector housing having opposite front and rear ends, a lock formed at an external position on the first housing;

a second connector housing having opposite front and rear ends, a forwardly open receptacle extending into the front end of the second connector housing;

a resilient engaging portion cantilevered forwardly in the receptacle of the second connector housing and being resiliently displaceable between a first position and a second position where the resilient engaging portion engages the lock of the first connector housing when the connector housings are properly connected;

a slider assembled with the first connector housing and movable forward and backward along connecting and separating directions of the connector housings, the slider being formed to substantially surround a plurality of outer circumferential surfaces of the first connector housing, the slider being dimensioned to be slidably inserted into the receptacle of the second connector housing when the first and second connector housings are connected with each other.

2. The connector of claim 1, wherein the slider is formed to substantially surround at least two outer surfaces of the first connector housing.

3. The connector of claim 2, wherein the slider is frame shaped and substantially surrounds all outer surfaces of the first connector housing.

4. The connector of claim 1, further comprising biasing means for biasing the slider toward the second connector housing, and wherein the slider comprises at least one externally exposed operable portion for moving the slider away from the second connector housing, against biasing forces of the biasing means, to a position where a displacement of the resilient engaging portion to the first position is permitted.

5. The connector of claim 4, wherein the operable portion is spaced back from a leading end of the second connector housing when the first connector housing is connected properly with the second connector housing.

6. The connector of claim 4, wherein two operable portions are provided symmetrically on outer surfaces of the slider.

7. The connector of claim 1, wherein the resilient engaging portion is resiliently displaceable in a direction intersecting with the connecting and separating directions.

8. The connector of claim 7, wherein the resilient engaging portion is longitudinally engageable with the slider when in the first position and wherein the resilient engaging portion is longitudinally disengaged from the slider when in the second position.

9. The connector of claim 8, wherein the slider engaged with the resiliently engaging portion located in the first position is moved away from the second connector housing against a biasing force of the biasing means, both at an intermediate stage of an operation of connecting the connector housings and at an intermediate stage of an operation of separating the connector housings.

10. The connector of claim 9, wherein when the connector housings are properly connected with each other, the resilient engaging portion is longitudinally disengaged from the slider by being resiliently displaced to the second position and the slider can be moved toward the second connector housing by the release of the biasing force accumulated in the biasing means.

11. A connector having at least first and second connector housings that are connectable with each other, comprising:

a retainer insertable into the first connector housing for locking terminal fittings in the first connector housing;

a slider assembled with the first connector housing and movable forward and backward along connecting and separating directions of the connector housings, the slider being provided with a detecting portion for detecting a mounted state of the retainer, and the slider being formed to substantially surround at least one outer circumferential surface of the first connector housing; and a resilient engaging portion provided in the second connector housing and being resiliently displaceable between a first position and a second position when the connector housings are properly connected.

12. The connector of claim 11, wherein the retainer is insertable into the first connector housing through a retainer insertion portion of the slider, wherein the mounted state of the retainer is detected when no interference occurs between the retainer and the retainer insertion portion.

13. The connector of claim 1, wherein the inner surfaces of the slider is held in sliding contact with the outer surfaces of the first connector housing.

* * * * *